US009052120B2

(12) United States Patent
Villar

(10) Patent No.: US 9,052,120 B2
(45) Date of Patent: Jun. 9, 2015

(54) EQUIPMENT STAND

(75) Inventor: Alexander Patrick Villar, Miami, FL (US)

(73) Assignee: Miami Tech, Inc., Miami, FL (US)

( * ) Notice: Subject to any disclaimer, the term of this patent is extended or adjusted under 35 U.S.C. 154(b) by 24 days.

(21) Appl. No.: 13/620,551

(22) Filed: Sep. 14, 2012

(65) Prior Publication Data

US 2014/0075980 A1 Mar. 20, 2014

(51) Int. Cl.
*F24F 13/22* (2006.01)
*F24F 13/32* (2006.01)

(52) U.S. Cl.
CPC ..... *F24F 13/32* (2013.01)

(58) Field of Classification Search
CPC ..... F16M 5/00; F16M 9/00; F16M 11/00; F16M 11/30; F16M 11/20; F24F 13/32
USPC ..... 248/237, 146, 158, 688, 677, 678
See application file for complete search history.

(56) References Cited

U.S. PATENT DOCUMENTS 3,698,564 A * 10/1972 Muller ..... 211/119.003
3,875,699 A * 4/1975 Lamarre ..... 47/46
3,957,250 A * 5/1976 Murphy ..... 256/19
4,802,422 A * 2/1989 Beard ..... 108/64
4,819,448 A * 4/1989 Bardo et al. ..... 62/304
4,989,826 A * 2/1991 Johnston, Jr. ..... 248/676
5,067,685 A * 11/1991 Johnston, Jr. ..... 248/676
5,107,775 A * 4/1992 Langlais et al. ..... 108/147.21
5,308,037 A * 5/1994 Gonzalez ..... 248/670
5,371,988 A * 12/1994 Hannes ..... 52/282.1
5,407,171 A * 4/1995 Gonzalez ..... 248/670
5,451,028 A * 9/1995 Lietti ..... 248/676
5,704,188 A * 1/1998 Coulis ..... 52/834
5,820,092 A * 10/1998 Thaler ..... 248/237
5,878,984 A * 3/1999 Grieser et al. ..... 248/188.8
5,960,601 A * 10/1999 Offutt ..... 52/292
6,467,756 B1 * 10/2002 Elsasser ..... 256/65.14
6,488,247 B1 12/2002 Gonzalez
6,508,457 B1 * 1/2003 Knudson et al. ..... 256/65.01
6,516,584 B1 * 2/2003 Rudd ..... 52/846
6,663,070 B2 * 12/2003 Valentz et al. ..... 248/354.1
6,892,991 B1 * 5/2005 Soh ..... 248/188.2
6,979,778 B2 * 12/2005 Xiong et al. ..... 174/50
7,458,556 B1 * 12/2008 Manucy ..... 248/676
7,506,593 B2 * 3/2009 Strabel, III ..... 108/156
7,752,861 B2 * 7/2010 Ishihara et al. ..... 62/262
7,850,148 B2 * 12/2010 Collins, IV ..... 256/65.14

(Continued)

OTHER PUBLICATIONS 2011-2012 Miami Tech Inc. Metal Products Catalog, Alumunum Telescoping Condensing-Unit Stands, p. 19.

*Primary Examiner* — Nkeisha Smith
(74) *Attorney, Agent, or Firm* — Steven M. Greenberg, Esq.; Kara A. Brotman, Esq.; CRGO Law

(57) ABSTRACT

An A/C system can be provided. The A/C system can include an A/C unit and an equipment stand supporting the A/C unit. The equipment stand can include a plurality of legs. Each leg can include a hollow tube defining an interior hollow space bounded by an interior surface of the hollow tube and a longitudinal internal support means for strengthening the hollow tube integrally formed in the interior surface of the hollow tube. Further, an equipment elevation system can be provided that includes at least one piece of equipment and an equipment stand supporting the at least one piece of equipment.

21 Claims, 4 Drawing Sheets

(56) References Cited

U.S. PATENT DOCUMENTS 8,348,071 B1 * 1/2013 Janlert ..... 211/175
8,528,282 B1 * 9/2013 Hemphill et al. ..... 52/238.1
2004/0194678 A1 * 10/2004 Waner ..... 108/147.21
2005/0269558 A1 * 12/2005 Keefe ..... 256/64
2010/0320360 A1 * 12/2010 McLeod ..... 248/678
2012/0193505 A1 * 8/2012 Baron ..... 248/636

* cited by examiner

EQUIPMENT STAND

BACKGROUND OF THE INVENTION

1. Field of the Invention

The present invention relates to equipment stands, including stands for elevating equipment.

2. Description of the Related Art

An air conditioner (A/C) is an appliance designed to dehumidify and extract heat from an area. Power generators are designed to supply power to a facility, such as a home and a business. The installation of A/C units and power generators must meet local, state, and federal standards, if any exist. For example, the rooftop installation of A/C unit(s), such as with multifamily dwellings or businesses, must be elevated to a specific height dependent on the size of the unit, so as to allow access to the roof of a building. An A/C stand is often used to reach the appropriate height. As a further example, a power generator that is positioned adjacent to a building may need to be elevated with a stand to prevent electrical issues that may be caused by flooding.

Any A/C stand, in fact any stand that rises above ground-level, must also meet any specified building code. Building codes most often reflect the state (or city) in which they are enacted. For example, in the State of Florida, the state building code takes into consideration the likelihood of hurricanes, the accompanying winds, and rains that may cause flooding. In addition, building codes can change over time. For instance, the wind loading criteria for mechanical equipment, appliances, and supports that are exposed to wind increased from one hundred forty miles per hour in the old Florida Building Code 2007, American Society for Civil Engineers (ASCE) 7-05, to one hundred eighty miles per hour in the more recently enacted Florida Building Code 2010, ASCE 7-10. Of note, Florida Building Code specifies wind load requirements based on location from as low as one hundred ten miles per hour to as high as one hundred eight miles per hour. In addition, the required design pressures that rooftop structures and equipment are required to meet became more stringent between the 2007 and 2010 building code changes.

BRIEF SUMMARY OF THE INVENTION

Embodiments of the present invention address deficiencies of the art in respect to equipment stands. In an embodiment of the invention, an A/C system is provided. The A/C system can include an A/C unit and an equipment stand supporting the A/C unit. The equipment stand can include multiple different legs. Each leg can be formed by a hollow tube with longitudinal internal support means for strengthening the hollow tube. The longitudinal internal support means can be integrally formed in the interior surface of the hollow tube.

Another embodiment of the invention provides for an A/C system including an equipment stand adapted to receive and secure an A/C unit. The equipment stand can include multiple different hollow tubes. Each hollow tube can define an interior hollow space bounded by an interior surface of the hollow tube. Further, the hollow tube can include at least one flange integrally formed along at least one portion of the interior surface of the hollow tube.

In yet a different embodiment, an equipment elevation system is provided. The equipment elevation system can include at least one piece of equipment and an equipment stand supporting the at least one piece of equipment. The equipment stand can include multiple different legs. Each leg can be formed by a hollow tube with longitudinal internal support means for strengthening the hollow tube. The longitudinal internal support means can be integrally formed in the interior surface of the hollow tube.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and, together with the description, serve to explain the principles of the invention. The embodiments illustrated herein are presently preferred; however, the invention is not limited to the precise arrangements and instrumentalities shown, wherein.

DETAILED DESCRIPTION OF THE INVENTION

Embodiments of the invention provide for an equipment stand. In accordance with an embodiment of the invention, an A/C system can include an A/C unit elevated per applicable building code by an equipment stand. The equipment stand can include multiple legs. Each leg can be formed from hollow tubing and internal flanges extending from one portion of an internal surface of the tubing to another portion of the internal surface of the tubing. For instance, the flanges can include different spokes extending from different portions of the internal surface of the tubing of the leg. In this way, each leg can enjoy superior strength so as to sustain a higher wind load without requiring the leg to have a particularly large diameter.

Figure 1A:
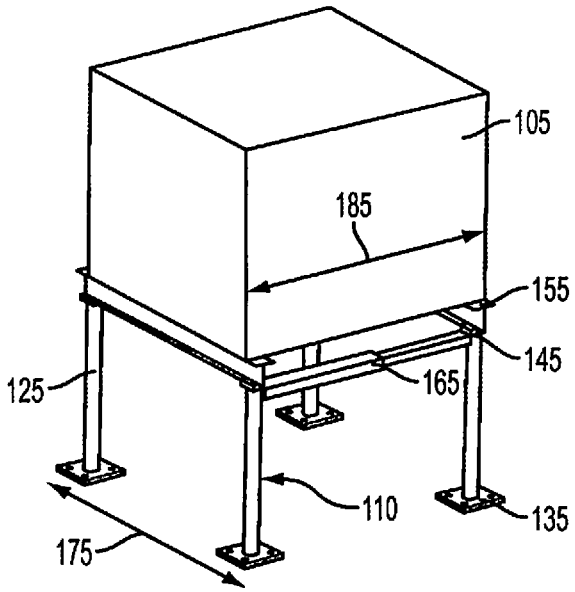
FIG. 1A is an isometric projection of a A/C unit on an equipment stand in an embodiment of the invention.

In further illustration, FIG. 1A is an isometric projection of an A/C unit 105 affixed to an equipment stand 110 in an embodiment of the invention. The equipment stand 110 can include a plurality of base plates 135 (see FIGS. 4A and 5C for different embodiments of a base plate). In one embodiment, there can be a total of four base plates 135. Each base plate 135 can be configured to allow a leg 125 to fit. In other words, if there are four base plates 135, there would be four legs 125. Of note, the equipment stand 110 can include a varying number of legs 125 and, hence, base plates 135. Further, a plurality of equipment stands 110 can be configured so that a plurality of A/C units 105 or other equipment, such as power generators, can be elevated; therefore, the number of legs 125 and base plates 135 may further vary in this type of embodiment. A leg 125 can be made from tubing, which can be of varying shapes, including but not limited to elliptical, cylindrical, polygonal, circular, oval, square, and rectangular. In addition, each leg 125 can be a hollow tube defining a hollow space bounded by an interior surface of the hollow tube. The hollow tube can further include a longitudinal internal support means for strengthening the hollow tube. The longitudinal internal support means can be integrally formed in the interior surface of the hollow tube. Further, each leg 125 can have either the same or different cross section as another leg 125. Even further, each leg 125 can also taper. For instance, if a leg 125 is made from cylindrical tubing, the radius of the tubing can vary along the length of the tube.

For example, in an embodiment of an equipment stand 110, the cross section of a tube forming a leg 125 can be circular comprising a plurality of flanges. A flange is defined as a protruding rim, edge, rib, or collar, as on a wheel or pipe shaft, used to strengthen an object, hold it in place, or attach it to another object. In one instance, there can be four flanges; each flange can extend from the center of the tube (center of the circular cross section) to the edge of the tube, where each flange is separated by about a ninety degree angle (as illustrated in see FIG. 3A). In another embodiment, there can be a plurality of flanges, extending from the interior (often, but not necessarily in the center) of a tube of varying shapes to an edge or interior surface of the tube. In yet another embodiment, there can be three flanges, where each flange can extend through a center of the interior hollow space of a cylindrical tube to a portion of the interior surface of the hollow tube. Further, each flange can be separated by about one hundred twenty degrees (as illustrated in FIGS. 3B, 3N, and 3O). In even another embodiment, an equipment stand 110 can be adapted to receive and secure an A/C unit 105. The equipment stand 110 can include multiple, different hollow tubes. Each hollow tube can define an interior hollow space bounded by an interior surface of the hollow tube and can include at least one flange integrally formed along at least one portion of the interior surface of the hollow tube.

A cross-member 165 can be attached between a pair of legs 125. More specifically, in one embodiment, one end of a cross-member 165 can be attached to the approximate top end of a leg 125. The opposite end of the cross-member 165 can be coupled to the top end of a second leg 125. Each cross-member 165 can be coupled to each leg 125 using any method now known or later developed, including but not limited to fastening (using pins, screws, etc.) and welding. There can be a plurality of cross-members 165 depending on how many equipment stands 110 are coupled together. In one embodiment, there are two cross-members 165, each cross-member 165 being attached between a pair of legs 125 with each cross-member 165 situated along the depth 185 of an equipment stand 110. The two cross-members 165 can be situated opposite each other in a parallel manner in an equipment stand 110. A cross-member 165 can be made of any material, including metal, such as aluminum.

Figure 5A:
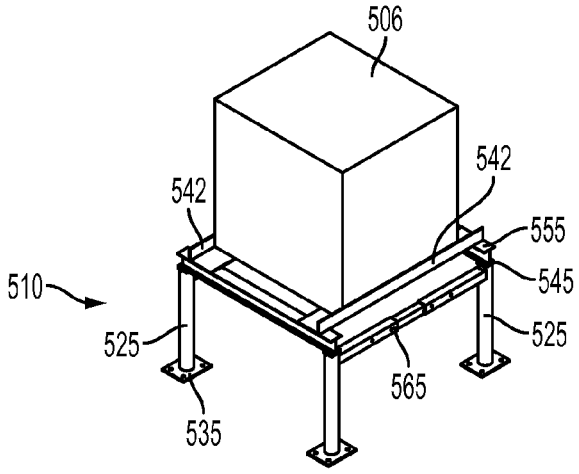
FIG. 5A is an isometric projection of an equipment stand upon which equipment, such as a power generator, is disposed upon in an embodiment of the invention.

Further, a cross-member 165 can be manufactured using any method now known or later developed, including but not limited to extrusion. In one embodiment, a cross-member 165 can be formed by coupling two tubes. More specifically, a cross-member 165 can be formed with a first square tube, having a first perimeter, and a second square tube, having a second perimeter, where the first perimeter is smaller than the second perimeter. In this way, the first tube can nest in the second tube. Further, the first tube can be interlocked with the second tube and can be coupled together using a thru bolt or similar fastener. In addition, a cross-member 165 can be telescopic. This enables an equipment stand 110 to vary in size to accommodate different sized A/C units 105. In another embodiment (as illustrated in FIG. 5A), the cross-member 165 can be formed by coupling three tubes. More specifically, a cross-member 165 can be formed by a first square tube, having a first perimeter, and two second square tubes, each second square tube having a second perimeter. Of note, the two second square tubes can have the same second perimeter. In this way, the first tube can nest in at least a portion of each second tube. Further, the first tube can be interlocked with each second tube and can be coupled together using a thru bolt or similar fastener. Of further note, though square tubes are referenced, the tubes can be any shape, including but not limited to oval, circular, elliptical, and rectangular.

A rail 155 can be coupled to the top of a pair of legs 125. The bottom of each end of a rail 155 can be configured to fit a C-channel 145. Each C-channel 145 can be coupled to the top end of each leg 125. In other words, in one embodiment of an equipment stand 110, there can be a plurality of rails 155, for instance two, where each rail 155 is situated along the width 175 of an equipment stand 110, where the bottom of each end of a rail 155 is configured to fit a coupled C-channel 145 (for a total of two C-channels 145 per rail 144), and each C-channel 145 is coupled to the top of each leg 125. Each rail 155 is situated opposite a second rail 155 and perpendicular to a cross-member 165. In one embodiment, the rail 155 is an I-beam. The I-beam and the C-channel 145 can each be made of any material, including but not limited to metal, such as aluminum alloy.

An A/C unit 105 can be coupled to the rails 155 of an equipment stand 110. Specifically, the A/C unit 105 can be coupled using a variety of methods, including but not limited to fastening, with for example, straps, bolts, screws, and brackets. In this way, an A/C system can be provided. Specifically, an A/C unit 105 can be coupled to an equipment stand 110, where the equipment stand 110 comprises a plurality of legs 125. Each leg 125 can be formed from a tube that has a cross section comprising at least one flange. In this way, the equipment stand 110 can conform to the 2010 Florida Building Code (FBC) with respect to wind loads and design pressures. Specifically, 2010 FBC, American Society of Civil Engineers (ASCE) 7, Section 301.12. In an embodiment, the equipment stand 110, which can supports equipment, such as an A/C unit 105 or a power generator, can withstand a wind load of at least one hundred ten miles per hour. In another embodiment, the equipment stand 510 can withstand wind loads of at least one hundred eighty miles per hour.

Figure 1B:
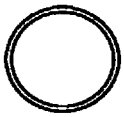
FIG. 1B is a prior art cross section of cylindrical tubing used in a leg of an equipment stand.

In further illustration, FIG. 1B is a prior art cross section of cylindrical tubing used in a leg of an equipment stand.

Figure 2:
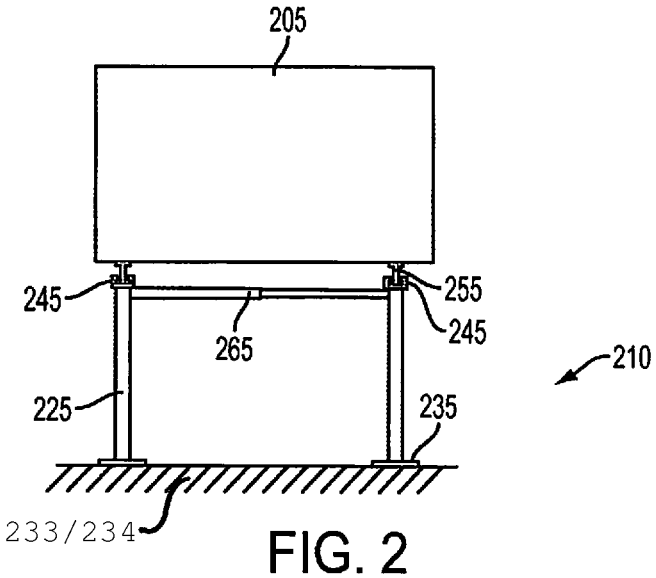
FIG. 2 is an end elevation view of a A/C unit on an equipment stand in an embodiment of the invention.

In further illustration, FIG. 2 is an end elevation view of an AIC unit 205 on an equipment stand 210 in an embodiment of the invention. As shown in FIG. 2, an equipment stand 210 is adapted to receive and secure an A/C unit 205. The A/C unit 205 rests on two rails 255 that can be configured to fit a coupled C-channel 245 on the bottom of each end of a rail 255. Each C-channel 245 can be coupled to the top of a leg 225. Also shown in FIG. 2, as positioned at the approximate top of a leg 225, is a cross-member 265. The cross-member 265 is pictured between two legs 225, running along the depth of an equipment stand 210. Each leg 225 is coupled to a base plate 235. Each base plate 235 can be attached to a roof 234 or roof host structure. Of note, the base plate 235 is not limited to being coupled to a roof 234 or a roof host structure. In other words, a base plate and, thus, an equipment stand 210 can be ground-mounted. In this way, the equipment stand 210 can sit adjacent to a structure (a commercial building, a home, etc.) at approximate ground level and not disposed on top of the structure. Of further note, multiple, different base plates 235 may not be required. In addition, the equipment stand 210 may be coupled in a different manner (welding, glue, fasteners directly through a leg 225) to the ground 233 and/or roof 234.

Figure 3A:
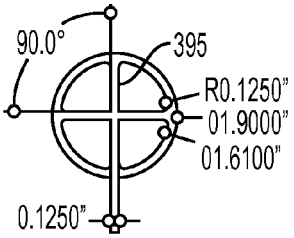
FIG. 3A is a cross section of a leg of an equipment stand in an embodiment of the invention.
Figure 3B:
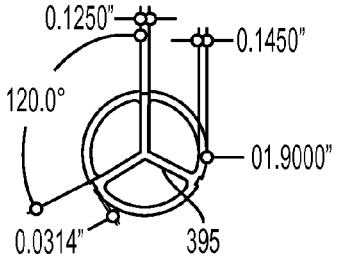
FIG. 3B is a cross section of a leg of an equipment stand in an embodiment of the invention.
Figure 3C:
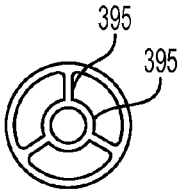
FIG. 3C is a cross section of a leg of an equipment stand in an embodiment of the invention.
Figure 3D:
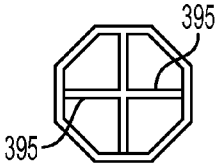
FIG. 3D is a cross section of a leg of an equipment stand in an embodiment of the invention.
Figure 3E:
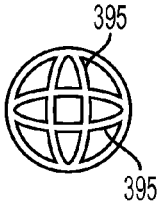
FIG. 3E is a cross section of a leg of an equipment stand in an embodiment of the invention.
Figure 3F:
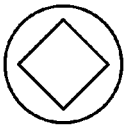
FIG. 3F is a cross section of a leg of an equipment stand in an embodiment of the invention.
Figure 3G:
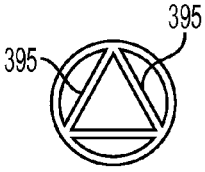
FIG. 3G is a cross section of a leg of an equipment stand in an embodiment of the invention.
Figure 3H:
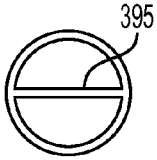
FIG. 3H is a cross section of a leg of an equipment stand in an embodiment of the invention.
Figure 3I:
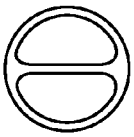
FIG. 3I is a cross section of a leg of an equipment stand in an embodiment of the invention.
Figure 3J:
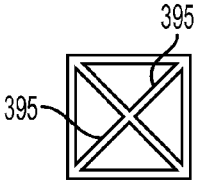
FIG. 3J is a cross section of a leg of an equipment stand in an embodiment of the invention.
Figure 3K:
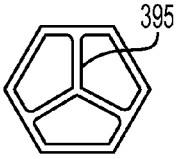
FIG. 3K is a cross section of a leg of an equipment stand in an embodiment of the invention.
Figure 3L:
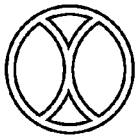
FIG. 3L is a cross section of a leg of an equipment stand in an embodiment of the invention.
Figure 3M:
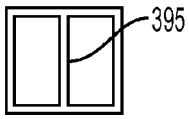
FIG. 3M is a cross section of a leg of an equipment stand in an embodiment of the invention.
Figure 3N:
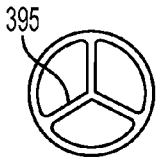
FIG. 3N is a cross section of a leg of an equipment stand in an embodiment of the invention.
Figure 3O:
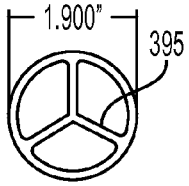
FIG. 3O is a cross section of a leg of an equipment stand in an embodiment of the invention.

In further illustration, FIGS. 3A-3O shows several different cross sections of tubing used in a leg of an equipment stand in an embodiment of the invention. More specifically, in one embodiment as illustrated in FIG. 3A, cylindrical tubing used in forming a leg, made of aluminum, can be extruded such that a cross section of the cylindrical tubing can include four flanges 395 with each flange 395 extending from the center of the interior hollow space of the cylindrical tubing to one portion of the interior surface of the hollow cylindrical tube. Each flange 395 can be set at about ninety degrees from a different flange 395. Of note, the specific dimensions of the cross section can vary, but in one embodiment, the dimensions can be as shown in FIG. 3A.

FIGS. 3B, 3N, and 3O are additional embodiments of the invention illustrating a different cross section of cylindrical tubing used in forming a leg of an equipment stand. As shown in FIGS. 3B, 3N, and 3O, the cylindrical tubing can be extruded in such a way that three flanges 395 can extend from the center of the cylindrical tubing to one portion of the interior surface of the cylindrical hollow tubing. Each flange 395 can be set at about one hundred twenty degrees from a different flange 395. Of note, the specific dimensions of the cross section can vary, but, in one embodiment, the dimensions can be as shown in FIG. 3B. FIG. 3O illustrates an embodiment having an outer diameter of about 1.900 inches. Of further note, the cylindrical tubing can be made of aluminum, but it can be made of other materials as well.

In yet even further illustration, FIGS. 3C-3M show additional cross sections of tubing used to form a leg of an equipment stand. Of note, each cross section can, but does not have to, include a plurality of flanges 395. For example, in an embodiment, a tube (of varying shapes, for instance cylindrical, polygonal, or rectangular) can have one flange 395 that bisects the interior hollow space of a hollow tube thereby creating two different sections (for instance, FIGS. 3I, 3H, and 3M). Of note, the different sections can, but do not need to be, equal. The various cross sections can be achieved using any technique now known or later developed, including but not limited to extrusion. In addition, one or more inserts can also be used to achieve different cross sectional designs. In other words, an insert or inserts can be placed within a hollow cavity of a tube to achieve different cross sectional designs. (Of note, the tube can vary in size, dimension, including thickness, and shape, for instance elliptical, cylindrical, polygonal, circular, oval, square, rectangular, etc.) Further, the dimensions of each cross section are not specifically defined. Of further note, embodiments of cross sections are not limited to what are disclosed therein.

Figure 4A:
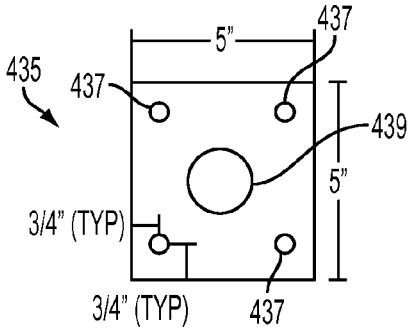
FIG. 4A is an engineering drawing of an embodiment of a base plate used in an equipment stand in an embodiment of the invention.

In further illustration, FIG. 4A is an embodiment of a base plate 435 for use in an embodiment of an equipment stand. A base plate 435 can include a plurality of apertures 437, for instance four. Each aperture 437 can be positioned about three-quarters of an inch from each edge so that the aperture 437 is located near the corner of the base plate 435. Each aperture 437 can be configured in such a way to enable an anchor or other fastener to pass through in order to secure the base plate 435 to a roof, a roof host structure, a ground surface, or any other surface upon which an equipment stand will be affixed. The apertures 437 can be of varying size, but in an embodiment can have a diameter equal to one-sixteenth of an inch larger than the diameter of an anchor. A larger aperture 439 can be positioned in the approximate center of the base plate 435, which is configured to allow a leg to fit. A leg of an equipment stand can be friction fitted into aperture 439. Of note, the base plate 435 can be manufactured using any technique now known or later developed. In addition, the base plate 435 can be made of aluminum alloy or any other material, such as other metals. Further, the base plate 435 can be of varying length, width, and thickness. For example, in one embodiment, the length and width of a base plate 435 can each be five inches, with the thickness varying per a set design schedule.

Figure 4B:
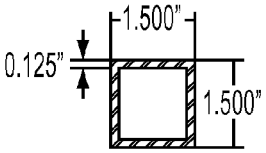
FIG. 4B is an engineering drawing of an embodiment of a cross section of tubing used to form a cross-member in an equipment stand.
Figure 4C:
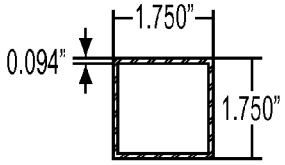
FIG. 4C is an engineering drawing of an embodiment of a cross section of tubing used to form a cross-member in an equipment stand.

In further illustration, FIGS. 4B and 4C depict cross sections of embodiments of two different sized square tubes that can be nested to form a cross-member. Further, each square tube of a cross-member can be interlocked and coupled to another using a thru bolt or similar fastener.

Figure 4D:
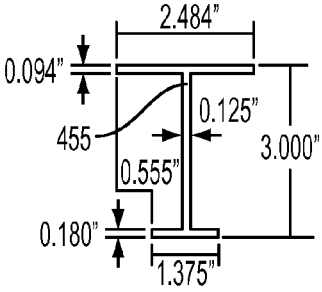
FIG. 4D is an engineering drawing of a cross section of an embodiment of a rail used in an equipment stand in an embodiment of the invention.
Figure 4E:
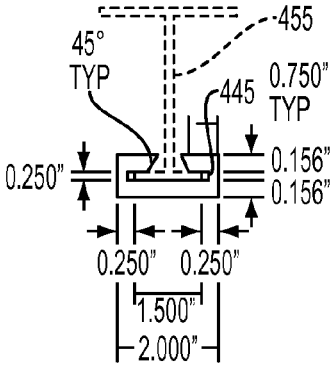
FIG. 4E is an engineering drawing of a cross section of an embodiment of a C-channel configured to fit a rail used in an equipment stand in an embodiment of the invention.

In even further illustration, FIG. 4D illustrates a cross section of an embodiment of a rail 455, where the rail 455 is an I-beam. The dimensions of a rail 455 can vary, but FIG. 4D illustrates one possible embodiment. In FIG. 4E, a cross section of an embodiment of a C-channel 445 configured to fit a rail 455 is shown. Of note, the dimensions of a C-channel 445 can vary, but FIG. 4E shows one possible embodiment.

In yet even further illustration, FIG. 5A shows an embodiment of an equipment stand 510 upon which equipment 506, such as a power generator, is disposed upon. In this way, an equipment elevation system can be provided. The equipment elevation system can include at least one piece of equipment 506 and an equipment stand 510 supporting the at least one piece of equipment 506. The equipment stand 510 can comprise a plurality of legs 525, each leg 525 comprising a hollow tube defining an interior hollow space bounded by an interior surface of the hollow tube. The hollow tube can further comprise a longitudinal internal support means for strengthening the hollow tube integrally formed in the interior surface of the hollow tube. In this way, the equipment stand 510 can conform to the 2010 Florida Building Code (FBC) with respect to wind loads and design pressures. Specifically, 2010 FBC, American Society of Civil Engineers (ASCE) 7, Section 301.12. In an embodiment, the equipment stand 510, which can support equipment 506, such as an A/C unit or a power generator, can withstand a wind load of at least one hundred ten miles per hour. In another embodiment, the equipment stand 510 can withstand wind loads of at least one hundred eighty miles per hour.

Of note, FIG. 5A is similar to FIG. 1A; both illustrate equipment stands elevating equipment. Specifically, FIG. 1A illustrates an equipment stand elevating an A/C unit, while FIG. 5A more generically shows the elevation of any equipment, including but not limited to a power generator unit or an A/C unit. The most noticeable differences between FIGS. 1A and 5A are the introduction of different styled cross-members 565 and the addition of support angles 542 in FIG. 5A. There are some additional differences with respect to dimensions of various elements, which are highlighted in the text below as well as in FIG. 5C. It should be noted that embodiments of the invention can vary in size, though embodiments with specific dimensions may be referenced.

Specifically, equipment 506, such as a power generator or A/C unit, can be coupled to multiple, different support angles 542. In this way, an equipment stand 510 can be configured for mounting smaller equipment 506 on wider stands 510. In an embodiment, there can be two support angles 542 that are coupled at each end to two different rails 555 (one at each end). Further, each support angles 542 can run along the side of the equipment stand 510 where the cross-member 565 is positioned. Of note, a support angle 542 can also be positioned along a different side of the equipment stand 510. The support angles 542 can be manufactured using any technique now known or later developed, included but not limited to extrusion. Further, a support angle 542 can be made of any material, including but not limited to metal, such as aluminum and steel.

Each support angle 542 can be coupled to each rail 555 using any technique now known or later developed, such as with fasteners or by welding. Further the bottom of each end of a rail 555 can be configured to fit a C-channel 545. Each C-channel 545 can be coupled to the top end of each leg 525. In an embodiment, each leg 525 can have a cross-section similar to what is illustrated in FIG. 3O with a diameter of about 1.900 inches. Though legs 525 with different cross-sections (similar to those illustrated in FIGS. 3A-3N) can be used.

Further, a cross-member 565 can be attached between a pair of legs 525. More specifically, in one embodiment, one end of a cross-member 565 can be attached to the approximate top end of a leg 525. The opposite end of the cross-member 565 can be coupled to the top end of a second leg 525. In an embodiment, the cross-member 565 can be formed by coupling three tubes. More specifically, a cross-member 565 can be formed by a first square tube, having a first perimeter, and two second square tubes, each second square tube having a second perimeter. Of note, the two second square tubes can have the same second perimeter. In this way, the first tube can nest in at least a portion of each second tube. Further, the first tube can be interlocked with each second tube and can be coupled together using a thru bolt or similar fastener. Of further note, though square tubes are referenced, the tubes can be any shape, including but not limited to oval, circular, elliptical, and rectangular.

Figure 5B:
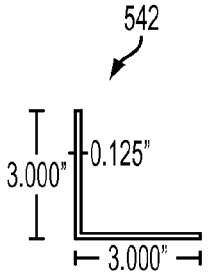
FIG. 5B is an engineering drawing of an end view of a support angle in an equipment stand; and, FIG. 5C is an engineering drawing of an embodiment of a base plate used in an equipment stand in an embodiment of the invention.
Figure 5C:
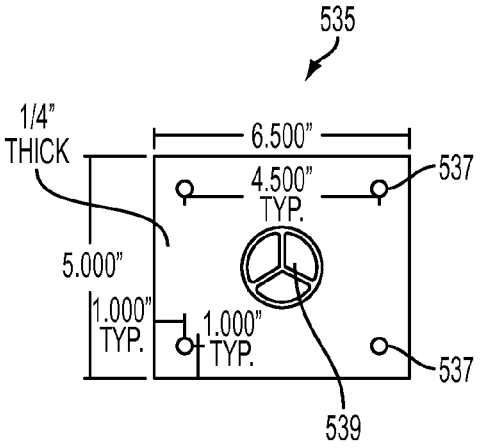

The equipment stand 510 can further include multiple, different base plates 535 (see FIGS. 4A and 5C for different embodiments of a base plate). In one embodiment, there can be a total of four base plates 535. Each base plate 535 can be configured to allow a leg 525 to fit through a center aperture.

In further illustration, FIG. 5B is an engineering drawing of an end view of a support angle 542 in an equipment stand 510. The dimensions of a support angle 542 can vary, but FIG. 5B illustrates one possible embodiment. Further, the length of a support angle 542 can vary depending on the spread or size of an equipment stand 510. The spread can be the distance between the center point of a first leg 525 and the center point of a second leg 525 as measured along the side having a cross-member 565. In one embodiment, the spread can be twenty inches; in another embodiment, thirty inches; in yet another embodiment, thirty six inches; and, in yet another embodiment, forty two inches. In another embodiment, a support angle 542 can be three inches by five inches by three-sixteenth inches.

In yet even further illustration, FIG. 5C is an engineering drawing of an embodiment of a base plate used in an equipment stand in an embodiment of the invention. A base plate 535 can include a plurality of apertures 537, for instance four. Each aperture 537 can be positioned about one inch from each edge so that the aperture 537 is located near the corner of the base plate 535. Each aperture 537 can be configured in such a way to enable an anchor or other fastener to pass through in order to secure the base plate 535 to a roof, a roof host structure, a ground surface, or any other surface upon which an equipment stand will be affixed. The apertures 537 can be of varying size, but in an embodiment can have a diameter equal to one-sixteenth of an inch larger than the diameter of an anchor. A larger aperture 539 can be positioned in the approximate center of the base plate 535, which is configured to allow a leg to fit. The larger aperture 539 can be larger in diameter than the diameter of the leg. Of note, FIG. 5C shows the base plate 535 as if a base plate 535 was already fitted with a leg having the specific cross-section pictured. Of further note, a leg of an equipment stand can be friction fitted into aperture 539. Of note, the base plate 535 can be manufactured using any technique now known or later developed. In addition, the base plate 535 can be made of aluminum alloy or any other material, such as other metals. Further, the base plate 535 can be of varying length, width, and thickness. For example, in one embodiment, the base plate 435 can each be six and a half inches by five inches with a quarter inch thickness. In another embodiment, the base plate 535 can be about five inches by five inches and can vary by thickness per a set schedule.

It should be noted; the equipment stand discussed herein can be used to elevate a variety of different types of equipment, such as but not limited to A/C units and power generators. In other words, the equipment stand is not limited to supporting (elevating) the equipment discussed herein, but the stand can be used when a stand is required to meet wind zone rating requirements or other requirements related to wind loads, including but not limited to wind speeds and design pressures, as indicated in building codes.

Having thus described the invention of the present application in detail and by reference to embodiments thereof, it will be apparent that modifications and variations are possible without departing from the scope of the invention defined in the appended claims as follows:

I claim:

1. An air conditioner (A/C) system, comprising:

an A/C unit; and, an equipment stand supporting the A/C unit, the equipment stand comprising a plurality of legs, each of the legs comprising a hollow tube defining an interior hollow space bounded by an interior surface of the hollow tube, the equipment stand further comprising four C-channels and two rails, a bottom portion of one end of each rail being fitted into one of the four C-channels and a bottom portion of an opposite end of each rail being fitted into a different one of the four C-channels, each of the C-channels being a single body having two forty-five degree angled ends facing one another and also being directly coupled to a different one of the plurality of legs, each of the C-channels further sharing a common vertical axis with the different one of the plurality of legs, each of the rails being directly coupled to the A/C unit;

each of the hollow tubes being aluminum and further comprising a longitudinal internal support means for strengthening each of the hollow tubes integrally formed in the interior surface of each of the hollow tubes.

2. The A/C system of claim 1, wherein the equipment stand conforms to 2010 Florida Building Code, American Society for Civil Engineers (ASCE) 7, Section 301.12.

3. The A/C system of claim 1, wherein the equipment stand is coupled to a roof.

4. The A/C system of claim 1, wherein the equipment stand is ground-mounted.

5. The A/C system of claim 1, wherein the equipment stand withstands a wind load of at least one hundred ten miles per hour.

6. An air conditioner (A/C) system, comprising:

an equipment stand adapted to receive and secure an A/C unit, the equipment stand comprising a plurality of hollow tubes, each hollow tube being aluminum and defining an interior hollow space bounded by an interior surface of the hollow tube and including at least one flange integrally formed along at least one portion of the interior surface of the hollow tube, the equipment stand further comprising four C-channels and two rails, a bottom portion of one end of each rail being fitted into one of the four C-channels and a bottom portion of an opposite end of each rail being fitted into a different one of the four C-channels, each of the C-channels being a single body having two forty-five degree angled ends facing one another and also being directly coupled to a different one of the plurality of hollow tubes, each of the C-channels further sharing a common vertical axis with the different one of the plurality of hollow tubes, each of the rails being directly coupled to the A/C unit.

7. The A/C system of claim 6, wherein the equipment stand comprises four flanges, each flange separated by about a ninety degree angle.

8. The A/C system of claim 6, wherein the equipment stand comprises three flanges, each flange separated by about a one hundred twenty degree angle.

9. The A/C system of claim 6, wherein at least one of the plurality of hollow tubes is a cylindrical-shaped hollow tube.

10. The A/C system of claim 6, wherein at least one of the plurality of hollow tubes is a rectangular-shaped hollow tube.

11. The A/C system of claim 6, wherein each hollow tube has at least one flange that extends from the at least one portion of the interior surface of the hollow tube to a portion of the interior hollow space of the hollow tube.

12. The A/C system of claim 6, wherein each hollow tube has at least one flange that bisects the interior hollow space of a hollow tube of the plurality of hollow tubes.

13. The A/C system of claim 6, wherein each hollow tube has at least one flange that extends from one portion of the interior surface of the hollow tube through a center of the interior hollow space to a second portion of the interior surface of a hollow tube of the plurality of hollow tubes.

14. The A/C system of claim 6, wherein the equipment stand is coupled to a roof.

15. The A/C system of claim 6, wherein the equipment stand is ground-mounted.

16. The A/C system of claim 6, wherein the equipment stand withstands a wind load of at least one hundred ten miles per hour.

17. An equipment elevation system, comprising:

at least one piece of equipment; and, an equipment stand supporting the at least one piece of equipment, the equipment stand comprising a plurality of legs, each of the legs comprising a hollow tube defining an interior hollow space bounded by an interior surface of the hollow tube, the equipment stand further comprising four C-channels and two rails, a bottom portion of one end of each rail being fitted into one of the four C-channels and a bottom portion of an opposite end of each rail being fitted into a different one of the four C-channels, each of the four C-channels being a single body having two forty-five degree angled ends facing one another and also being directly coupled to a different one of the plurality of legs, each of the C-channels further sharing a common vertical axis with the different one of the plurality of legs, each of the rails being directly coupled to the at least one piece of equipment which is an air conditioner unit;

each of the hollow tubes being aluminum and further comprising a longitudinal internal support means for strengthening each of the hollow tubes integrally formed in the interior surface of each of the hollow tubes.

18. The equipment elevation system of claim 17, wherein the equipment stand conforms to 2010 Florida Building Code, American Society for Civil Engineers (ASCE) 7, Section 301.12.

19. The equipment elevation system of claim 17, wherein the equipment stand is coupled to a roof.

20. The equipment elevation system of claim 17, wherein the equipment stand is ground-mounted.

21. The equipment elevation system of claim 17, wherein the equipment stand withstands a wind load of at least one hundred ten miles per hour.

* * * * *